United States Patent [19]

Studwell

[11] Patent Number: 4,617,773

[45] Date of Patent: Oct. 21, 1986

[54] CLADDING ELEMENT

[75] Inventor: Kevin A. R. Studwell, Sunnybank, Australia

[73] Assignee: Australian Design Marketing Pty. Ltd., Sunnybank, Australia

[21] Appl. No.: 836,981

[22] Filed: Mar. 6, 1986

Related U.S. Application Data

[63] Continuation-in-part of Ser. No. 566,326, Dec. 28, 1983, abandoned.

[51] Int. Cl.[4] ..... E04D 1/00

[52] U.S. Cl. ..... 52/537; 52/542; 52/535

[58] Field of Search ..... 52/535, 536, 537, 538, 52/542, 554, 555, 478

[56] References Cited

U.S. PATENT DOCUMENTS

| | | | |
|---|---|---|---|
| 1,266,137 | 5/1918 | Melde | 52/533 |
| 2,002,244 | 5/1935 | Kremper | 52/542 X |
| 3,629,988 | 12/1971 | Zylstra | 52/535 X |
| 4,189,889 | 2/1980 | Yanoh | 52/533 X |
| 4,201,024 | 5/1980 | Lafitte, Jr. | 52/536 X |
| 4,499,700 | 2/1985 | Gustafsson | 52/542 X |

*Primary Examiner*—Carl D. Friedman
*Assistant Examiner*—Creighton Smith
*Attorney, Agent, or Firm*—Laubscher & Laubscher

[57] ABSTRACT

A roof cladding element which is constructed to span at least two roof framing rafters and which, in use, avoids the need for conventional roofing battens. The cladding element is pressed from sheet steel and includes a panel portion, an inverted channel-shaped ridge formed along the top edge of the panel portion, a scalloped downwardly extending lip formed along the bottom edge of the panel portion, and a plurality of inverted channel-shaped ribs formed in the panel portion to extend to the bottom edge from an inner wall of the ridge. Also, a series of recesses are formed in the inner wall of the ridge, each recess being in alignment with one of the ribs and defining a cavity into which the associated rib extends.

10 Claims, 10 Drawing Figures

CLADDING ELEMENT

RELATED APPLICATION

This application is a continuation-in-part of application Ser. No. 566,326, filed Dec. 28 1983, now abandoned.

FIELD OF THE INVENTION

This invention relates to a cladding element which is suitable for use in cladding the roof or walls of a building. The cladding element has been developed as a roofing element, and is hereinafter described in such context, but it is to be understood that the element may also be used for cladding the walls of a building structure.

The cladding element is formed as a pressed sheet metal element and a plurality of the elements would normally be affixed to structural support members in overlapped relationship and thereby cover an area substantially greater than the surface area of a single element.

The invention also relates to a roof structure when clad with a number of the cladding elements.

BACKGROUND OF THE INVENTION

Conventional roofing systems employ various cladding elements, including terra-cotta tiles, concrete tiles, pressed or roll-formed metal panels, timber tile elements (shingles), fiberglass reinforced plastics material panels and various composite material panels. In addition to the dead weight which is applied to the structural members of a roof by these cladding elements, a roofing system can be subjected to further dead loads (imposed, for example, by snow), to wind loading and to other dynamic loadings imposed by, for example, seismic disturbances. These various types of load cause stresses to be induced in the structural members and/or in the cladding elements, and the elements may then break free from the structural members. In order to alleviate this problem, supplementary load bearing support members in the form of roofing battens and/or timber panels are customarily affixed to the skeletal structural members of a roof, and the cladding elements are affixed to the battens.

The cladding element of the present invention has been developed to provide an intrinsic, omnidirectional load bearing capability so that it might be affixed directly to roof rafters, trusses and/or stringers and, thus, so as to avoid the cost of providing and fixing the conventional roofing battens. The cladding element may also avoid the need for some of the customary roof frame bracings.

SUMMARY OF THE INVENTION

Broadly defined, the cladding element in accordance with the present invention is formed from sheet metal and it comprises a panel portion having opposed side edges and opposed top and bottom edges extending in a lateral direction between the side edges. An inverted channel-shaped ridge extends along the top edge of the panel portion and is formed integrally with the panel portion. The ridge includes an inner wall which forms an upwardly projecting extension of the panel portion. A plurality of ribs are formed in the panel portion and extend from the inner wall of the ridge in a direction toward the bottom edge of the panel portion. A series of recesses are formed in the inner wall of the ridge, with each recess being in alignment with one of the ribs, having the same width as the rib and defining a cavity into which the associated rib extends. Also, a downwardly projecting lip is formed at and extends along the bottom edge of the panel portion. Each cladding element preferably includes at least three ribs and most preferably has about twelve ribs.

The cladding element is intended in use to span and be secured to at least two structural members of a building. The ridge portion then performs a bracing function somewhat analogous to the conventional roofing battens, and the panel portion, while providing a load bearing structure, functions to provide the weather sealing features which are exhibited by other types of roof cladding. Adjacent (side-by-side) elements are affixed in overlapping relationship, with one rib of one element being nested below a rib of an adjacent (overlapping) element. Similarly, longitudinally arrayed elements are arranged in overlapping relationship, with the lip at the bottom edge of one element extending over the ridge of a lower element.

Two particularly important structural features characterise the cladding element; they being the inverted channel-shaped ridge which extends along the top edge of the panel portion and the recesses which are formed in the inner wall of the ridge to accommodate merging of the ribs and the inner wall of the ridge. The ridge functions in much the same way as a roofing batten and, when secured to the roofing rafters, ties the rafters together whilst providing an anchorage for the integrally formed panel portion of the cladding. The ribs are formed in and function to impart rigidity to the panel portion, and the ribs extend into and join the inner wall of the ridge in a manner which enhances the structural integrity of the cladding element. Thus, the bending strength of the cladding element is maximised by extending the ribs into the inner wall of the ridge and, in order to avoid the creation of unacceptably high stresses during formation of the cladding element, the recesses are formed as cavities in the inner wall of the ridge in alignment with the ribs.

The invention will be more fully understood from the following description of a preferred embodiment of the invention, the description being given with reference to the accompanying drawings.

DETAILED DESCRIPTION OF THE INVENTION

Figure 1:
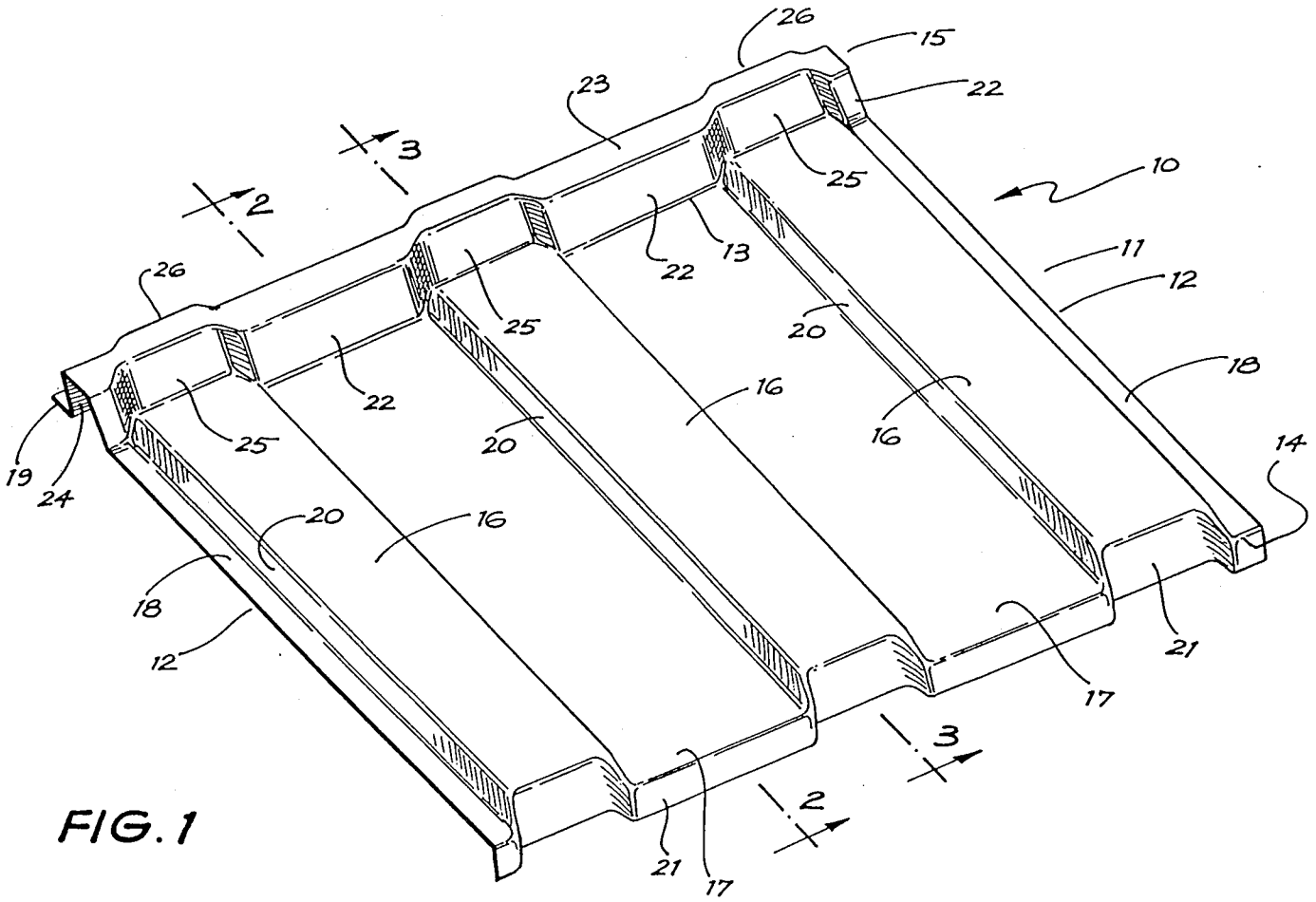
FIG. 1 is a perspective view of a single cladding element.
Figure 2:
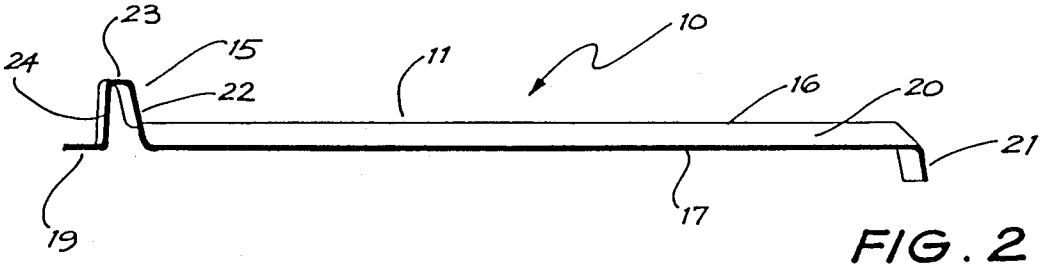
FIG. 2 shows a sectional elevation view of the cladding element as viewed in the direction of section plane 2—2 in FIG. 1.
Figure 3:
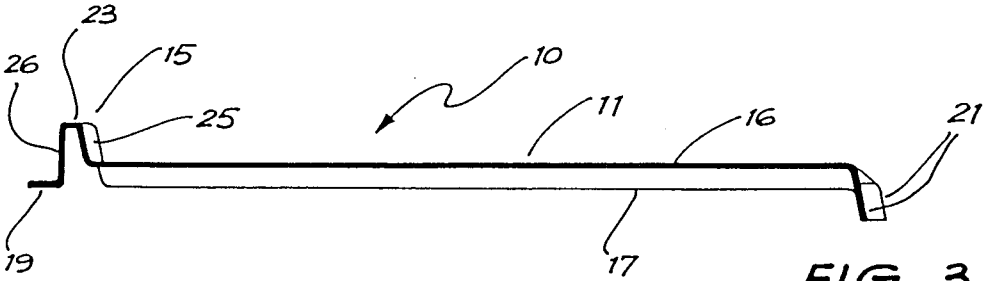
FIG. 3 shows a further sectional elevation view of the cladding element as viewed in the direction of section plane 3—3 in FIG. 1.

As illustrated in FIGS. 1 to 5 of the drawings, the cladding element 10 comprises a rectangular panel portion 11 having side edges 12, a top edge 13 and a bottom edge 14. An inverted channel-shaped ridge 15 extends along the top edge of the panel portion 11 and is formed integrally therewith. The ridge 15 functions in a manner similar to a roofing batten and, when secured to roof rafters as hereinafter described, the ridge 15 ties the rafters together and provides a firm anchorage for the panel portion 11 of the cladding element.

The complete cladding element is pressed from sheet metal and, while shown in FIG. 1 as having only three ribs 16 and two gulleys 17, the element would normally be sized to include approximately twelve ribs and eleven gulleys. The element may be made in various sizes, to suit the rafter spacing required by different building codes, but it might typically be 1.8 meters long, between the side edges 12, and 0.4 meters deep between the top and bottom edges 13 and 14 of the panel portion.

The ribs 16 function to impart rigidity to the panel portion 11 of the cladding and they have a width which is approximately equal to two-thirds of the spacing between the ribs.

For the purposes of this description, the cladding element may be considered as having a base plane which contains the lower surface or wall of the gulleys 17. Side projections 18 and an outward projection 19 of the ridge channel 15 also lie in the same base plane.

The ribs 16 are formed with side walls 20 which project upwardly from the base plane (i.e., from the lower wall of the gulleys 17) and the top surface of each rib is disposed approximately parallel to the gulley wall 17. Thus, the panel portion 11 has a generally corrugated configuration and the underside of the panel has a shape which complements the top surface which is shown in FIG. 1. The ribs and gulleys 16 and 17, while shown to have flat surfaces, may be formed to provide the panel with a more curvaceous (undulating) configuration.

The bottom edge 14 of the panel portion 11 is formed with a downwardly projecting lip 21. The lip 21 extends for the full width of the element and scallops inwardly at the terminal end of each of the ribs 16. Also, as is best seen from FIGS. 2 and 3 of the drawings, the lip 21 is inclined to lie parallel to an inner wall 22 of the ridge channel 15.

The inner wall 22 of the ridge channel projects upwardly at an obtuse angle to the base plane or gulleys 17 of the panel, and the inner wall then joins the top wall 23 of the ridge which lies parallel to the base plane 17. The outer wall 24 of the ridge channel joins the top wall 23 to the outwardly projecting flange 19, and the outer wall 24 is disposed at 90° to the base plane 17 of the panel.

Upwardly extending recesses 25 are formed in the inner wall 22 of the ridge channel, the respective recesses being in alignment with the ribs 16. Complementary, but smaller, projections 26 are formed in the outer wall of the ridge channel opposite each of the recesses 25.

It is to be noted that the ribs 16 extend for the full length of the panel portion 11 and that they actually project into and join the inner wall 22 of the ridge channel 15. This avoids any discontinuity in the bending strength of the cladding element, such as would occur if the ribs 16 were to terminate before reaching the ridge channel, and the structural integrity of the cladding element is enhanced by the physical interconnection or merging of the ribs with the ridge channel. The recesses 25 are formed in the inner wall 22 of the ridge channel, in alignment with the ribs 16, in order that the ribs may be projected into the wall 22 without creating excessive stresses in the metal during press forming of the cladding element. The recesses 25 have approximately the same width as the aligned ribs 16.

Figure 4:
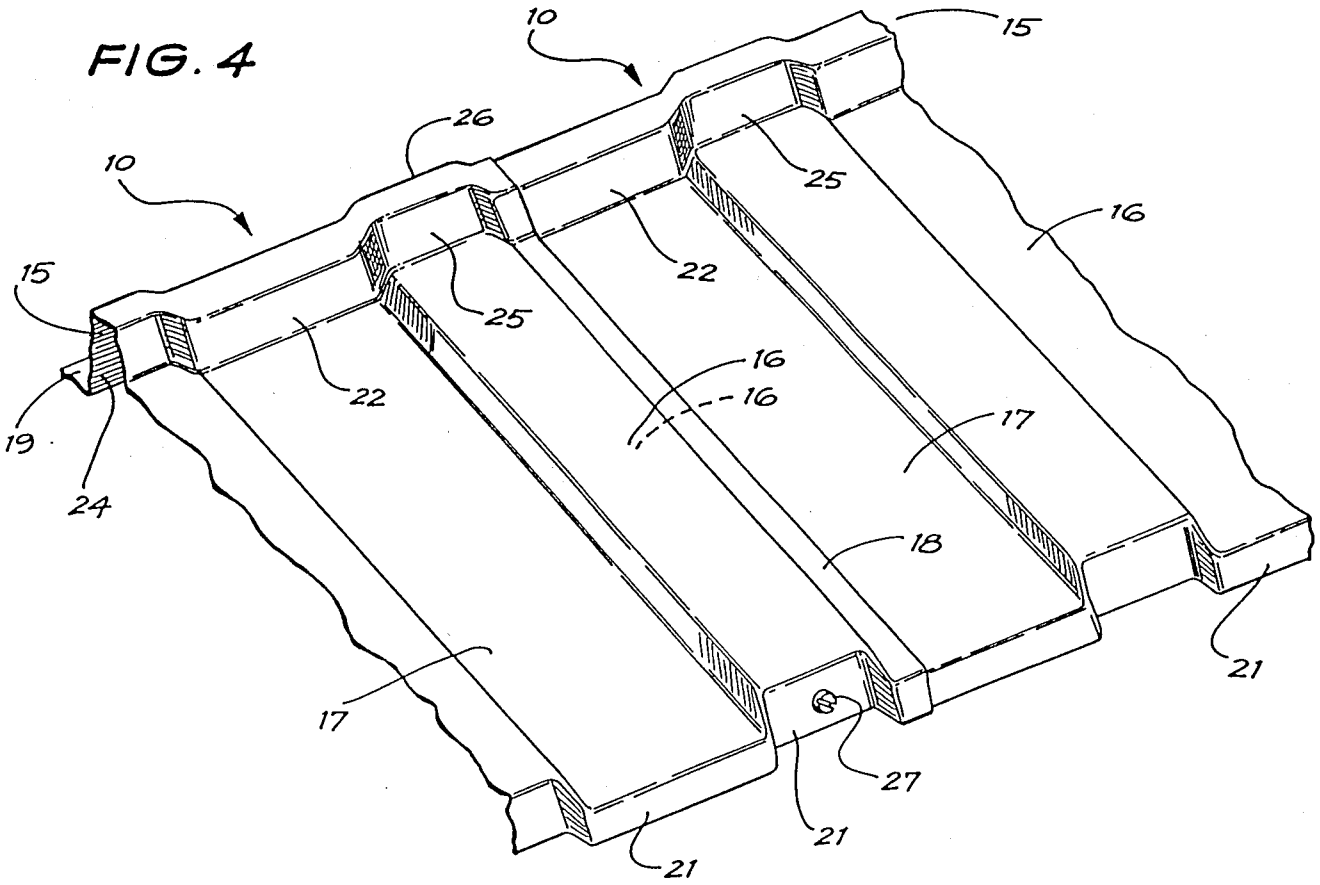
FIG. 4 shows a perspective view of two (partial) cladding elements which are interconnected in side-by-side overlapping relationship.

With the cladding element formed as above described and allowing for the inherent resilience of the pressed metal structure, two such elements may be mounted side-by-side in overlapping relationship as shown in FIG. 4. Thus, the right hand rib 16 of one element is positioned to overlie the left hand rib 16 of an adjacent element, and the two elements are interconnected by driving a self-tapping screw 27 through the lapped lips 21 of both elements. Also, as indicated in FIG. 5, screws 28 or other suitable fastening devices (such as clips) are employed to connect the outwardly projecting flange 19 of each channel element to each rafter 29 which is spanned by the cladding elements.

Figure 5:
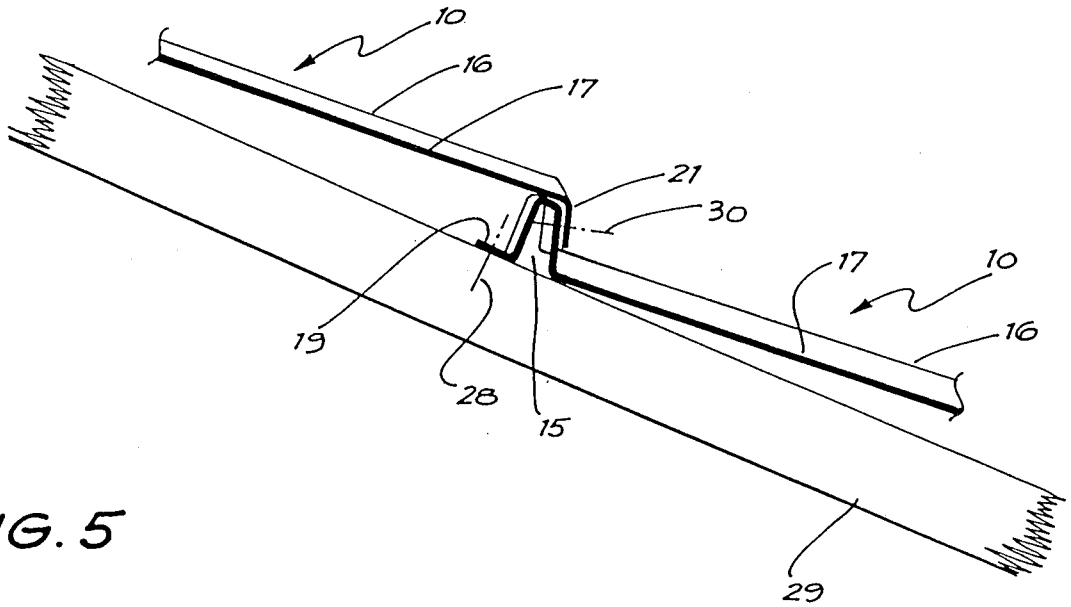
FIG. 5 shows a side elevation view of two (upper and lower) cladding elements mounted to a roof rafter, the elements being connected in end-to-end overlapping relationship.

As is also shown in FIG. 5, adjacent (upper and lower) cladding elements are overlapped in the longitudinal direction of the rafters 29. Thus, the lip 21 of an upper element is positioned to overlie the ridge 15 of a lower element, and a self-tapping screw 30 is driven through the two elements.

With the combined fastening effect provided by screws 27, 28 and 30, the cladding elements 10 are positively connected to one another and to the rafters 29.

Figure 6:
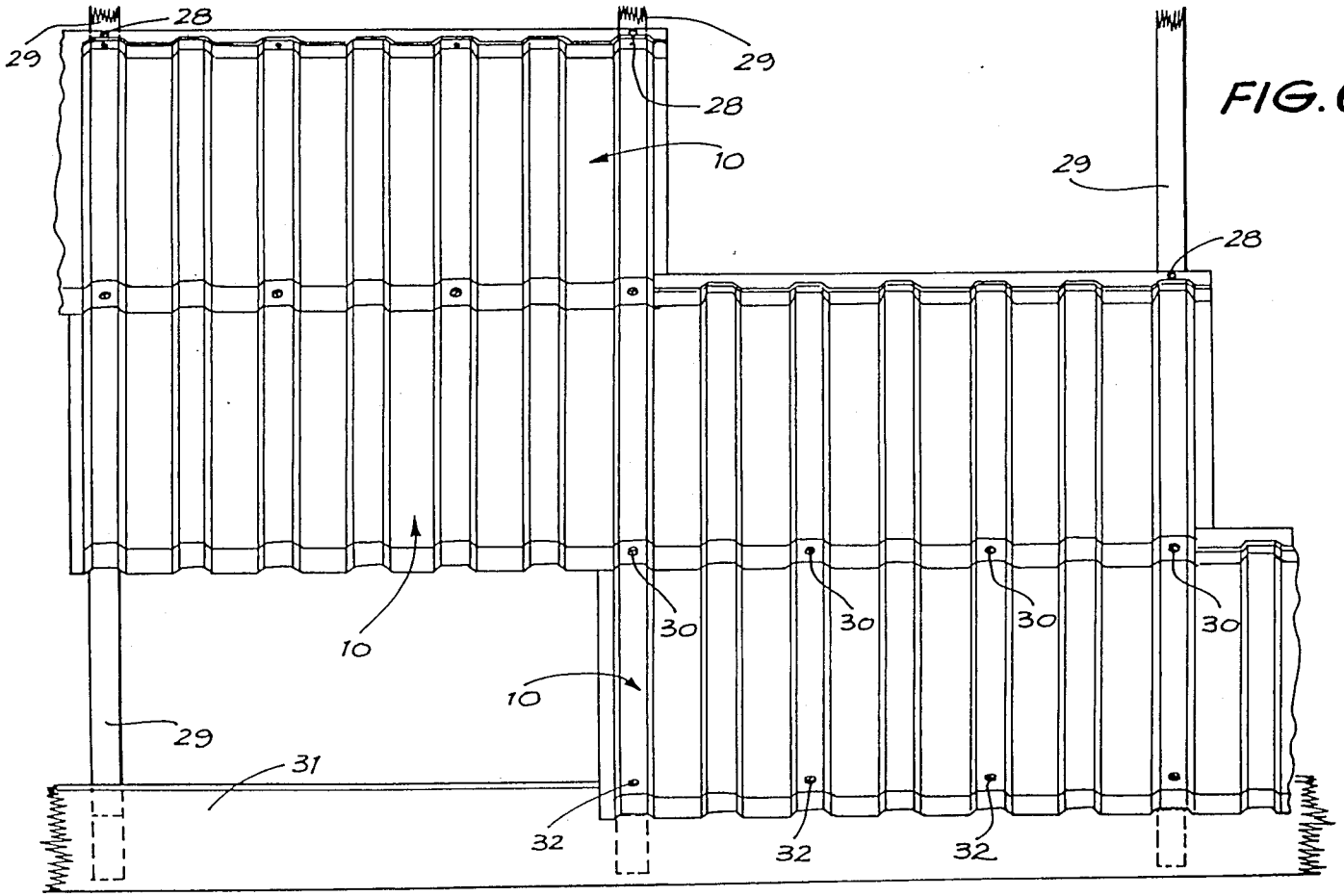
FIG. 6 shows a plan view of a number of cladding elements mounted to a portion of a roof structure, FIGS. 7A and 7B, respectively, show partial end elevation views of alternative arrangements for capping the upper margin of cladding elements at the ridge of a roof.

FIG. 6 of the drawings shows an oblique plan view of a portion of a roof structure (including rafters 29 and a facia board 31) and, in particular, the Figure shows a complete cladding element 10, and two partial such elements, spanning three rafters 29.

When laying the cladding elements, the first row is positioned above the facia board 31 and the cladding elements 10 of such row are secured to the facia board by fasteners 32. Thereafter, successive rows of the cladding elements are overlapped in the manner shown in FIG. 5 until the ridge of the roof is reached.

Figure 7A:
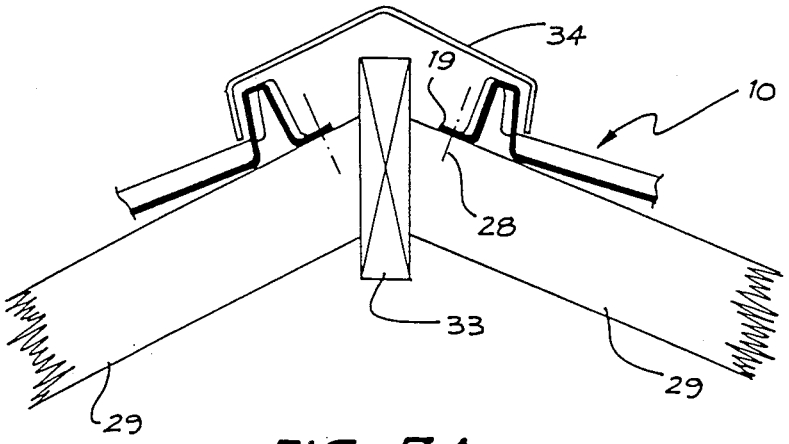

If the full depth of a cladding element 10 can be accommodated in the row nearest the ridge of the roof, the final row of the cladding elements is secured in the manner indicated in FIG. 7A. That is, the projecting flange 19 of each element is secured to the rafters 29 adjacent the ridge board 33 by fasteners 28. Then, a pressed metal ridge cap 34 is fitted over the ridge board and secured to the upper edges of the cladding elements.

Figure 7B:
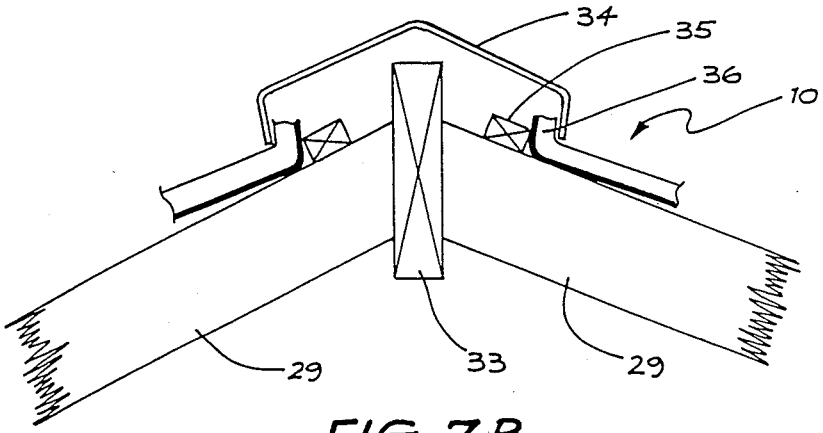

However, if the distance remaining between the second last row of cladding elements and the ridge board 33 is insufficient to accommodate the full depth of a cladding element, the arrangement shown in FIG. 7B is employed. In this case, a batten 35 is secured to the rafters 29 and is positioned to span the rafters in the longitudinal direction of the ridge board 33. Then, each cladding element in the final row of such elements is cut to an appropriate size and turned-up along its (new)

upper marginal edge 36 to form a weather barrier. The cap 34 is then fitted over the ridge.

Figure 8:
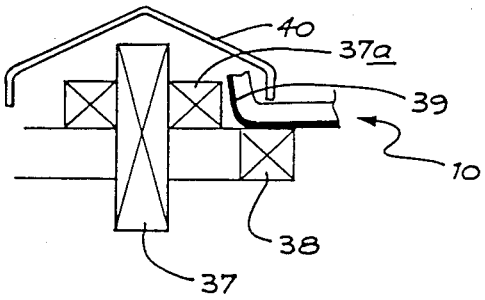
FIG. 8 shows a partial end elevation view of an arrangement for capping a side margin of a cladding element at the hip of a roof.

A similar arrangement, as shown in FIG. 8, is adopted when cutting a cladding element 10 to locate adjacent a hip board 37 of a roof structure and, in this case, a batten in the form of a hip board stringer 37*a* is secured to hip creeper rafters 38. When cut to size, the (new) side edge of the cladding element is turned up to provide a weather barrier 39, and a hip cap 40 is fitted.

Figure 9:
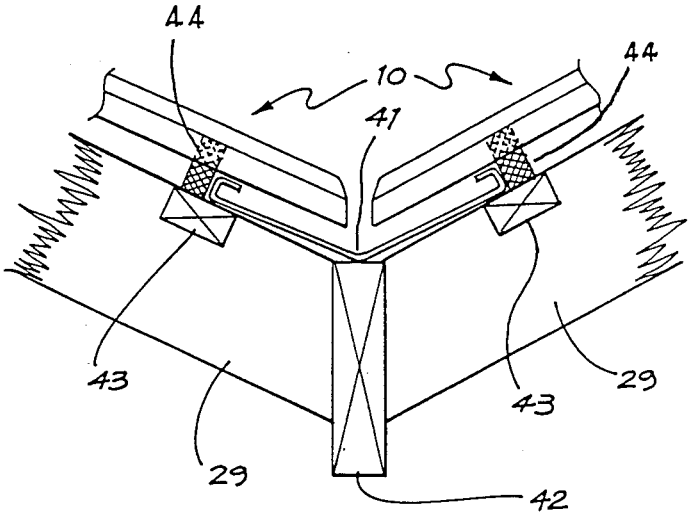
FIG. 9 shows a partial end elevation view of an arrangement for weather sealing a valley in a roof structure.

When fitting the cladding elements into a valley in a roof structure, as indicated in FIG. 9, the side edges of the cladding elements are cut as required and a valley channel 41 is positioned between the (new) marginal edges of the cladding elements. The channel is located above the valley rafter 42 and is affixed to stringers 43 which are let into the associated valley creeper rafters 29. Also, a strip 44 of an expandable synthetic plastics material is laid along the stringers 43 to bar access to the underside of the cladding elements from the valley channel 41.

I claim:

1. A sheet metal cladding element which is intended in use to span and to be secured to at least two structural members of a building, the cladding element comprising:

a panel portion having opposed side edges and opposed top and bottom edges extending in a lateral direction between the side edges, an inverted channel-shaped ridge extending along the top edge of the panel portion and formed integrally with the panel portion, the ridge being connectable to the building structural members by fasteners and, when so connected, functioning to tie the members together, and the ridge including an inner wall which forms an upwardly projecting extension of the panel portion, a plurality of upwardly projecting, inverted channel-shaped ribs formed in the panel portion and extending along the panel portion from the inner wall of the ridge in a direction toward the bottom edge of the panel portion, a series of recesses formed in the inner wall of the ridge, the recesses serving to enhance the structural integrity of the cladding element and providing for merging of the ribs with the inner wall of the ridge, each recess being in alignment with a respective one of the ribs, having a width equal to that of the rib and defining a cavity into which the associated rib extends, and a downwardly projecting lip formed at and extending along the bottom edge of the panel portion, the cladding element being arranged to locate in overlapping relationship with adjacent cladding elements, with a rib of one element being nested below a rib of a laterally adjacent element and with the lip at the bottom edge of one element extending over the ridge at the top edge of another of the elements.

2. The cladding element as claimed in claim 1 wherein the lower edge of the panel portion, including the lip, is scalloped inwardly in alignment with the ribs.

3. The cladding element as claimed in claim 1 wherein each rib has a width less than the spacing between the ribs.

4. The cladding element as claimed in claim 3 wherein each rib has a width approximately equal to two-thirds of the spacing distance between the ribs.

5. The cladding element as claimed in claim 1 wherein the spaces between the ribs are formed as non-inverted channel-shaped gulleys.

6. The cladding element as claimed in claim 1 wherein the inner wall of the ridge is inclined at an obtuse angle to a base plane of the panel portion and an outer wall of the ridge is disposed at approximately 90° to the base plane of the panel portion, with the included angle between the inner and outer walls being acute.

7. The cladding element as claimed in claim 6 wherein the outer wall of the ridge is formed with a series of outward projections which align with the recesses in the inner wall of the ridge.

8. The cladding element as claimed in claim 6 wherein a flange projects outwardly from the outer wall of the ridge, the flange being disposed in the base plane of the panel portion.

9. The cladding element as claimed in claim 2 wherein the lip projects downwardly for a distance which is aproximately equal to the height of the ridge above the upper level of the ribs.

10. The cladding element as claimed in claim 2 wherein the lip is inclined and lies parallel with the inner wall of the ridge.

* * * * *